US006883313B2

(12) United States Patent
Egelja et al.

(10) Patent No.: US 6,883,313 B2
(45) Date of Patent: Apr. 26, 2005

(54) ELECTRO-HYDRAULIC PUMP DISPLACEMENT CONTROL WITH PROPORTIONAL FORCE FEEDBACK

(75) Inventors: Aleksandar M. Egelja, Naperville, IL (US); Mikhail A. Sorokine, Naperville, IL (US); Srikishnan T. Tolappa, deceased, late of Aurora, IL (US); by Rangamani Srikrishnan, legal representative, Aurora, IL (US)

(73) Assignee: Caterpillar Inc, Peoria, IL (US)

( * ) Notice: Subject to any disclaimer, the term of this patent is extended or adjusted under 35 U.S.C. 154(b) by 70 days.

(21) Appl. No.: 10/301,559

(22) Filed: Nov. 21, 2002

(65) Prior Publication Data

US 2004/0099136 A1 May 27, 2004

(51) Int. Cl.[7] ..... F16D 31/02
(52) U.S. Cl. ..... 60/446; 60/445
(58) Field of Search ..... 60/445, 446, 447, 60/452; 92/12.2

(56) References Cited

U.S. PATENT DOCUMENTS

| | | | | |
|---|---|---|---|---|
| 3,665,814 A | | 5/1972 | Ankeny | |
| 3,976,098 A | | 8/1976 | Raymond | |
| 4,139,987 A | | 2/1979 | Budzich | |
| 4,479,104 A | | 10/1984 | Ettinger et al. | |
| 4,510,750 A | | 4/1985 | Izumi et al. | |
| 4,528,814 A | * | 7/1985 | Stuhr | 60/446 |
| 4,864,822 A | * | 9/1989 | Wachs et al. | 60/445 |
| 5,058,383 A | | 10/1991 | Tsunemi et al. | |
| 5,554,007 A | | 9/1996 | Watts | |
| 5,564,905 A | | 10/1996 | Manring | |
| 5,568,762 A | | 10/1996 | Manring | |
| 5,588,805 A | | 12/1996 | Geringer | |
| 5,865,602 A | | 2/1999 | Nozari | |
| 5,876,185 A | | 3/1999 | Schimpf et al. | |
| 6,179,570 B1 | | 1/2001 | Smith | |
| 6,374,722 B1 | | 4/2002 | Du et al. | |
| 6,375,433 B1 | | 4/2002 | Du et al. | |
| 6,468,046 B1 | | 10/2002 | Du et al. | |
| 2002/0176784 A1 | | 11/2002 | Du | |

* cited by examiner

*Primary Examiner*—Edward K. Look
*Assistant Examiner*—Michael Leslie
(74) *Attorney, Agent, or Firm*—J. W. Burrows; D James Barnes; Finnegan, Henderson, Farabow, Garrett & Dunner

(57) ABSTRACT

A pump displacement control arrangement uses the inherent swivel torques of a fluid translating device in cooperation with a proportional force feedback to more consistently and precisely control the displacement of the fluid translating device. The subject invention uses a variable displacement control arrangement having an actuator mechanism coupled to a swash plate of the fluid translating device and controlled by a proportional valve arrangement to control the displacement of the fluid translating device. A force feedback mechanism is disposed between the actuator mechanism and the proportional valve arrangement and provides a more precise and repeatable displacement control.

16 Claims, 4 Drawing Sheets

ELECTRO-HYDRAULIC PUMP DISPLACEMENT CONTROL WITH PROPORTIONAL FORCE FEEDBACK

TECHNICAL FIELD

This invention relates generally to an electro-hydraulic pump control system for controlling displacement of a pump. More particularly, the invention is directed to a method and arrangement for a hydraulic pump control that utilizes pump characteristics determined from operation of a pump and a force feedback control.

BACKGROUND

Variable displacement pumps are well known in the industry to drive an implement or a hydraulic motor or any combinations thereof. It is also well known that the speed of an actuator (i.e., hydraulic cylinder) and/or pressure of the fluid in the system may be controlled by varying the displacement of the hydraulic pump. Variable displacement pumps generally include a drive shaft, a rotatable cylinder barrel having multiple piston bores, and pistons held against a tiltable swash plate biased by a spring mechanism. When the swash plate is tilted relative to the longitudinal axis of the drive shaft, the pistons reciprocate within the piston bores to produce a pumping action. Each piston bore is subject to intake and discharge pressures during each revolution of the cylinder barrel. As the piston bores sweep pass the top and bottom center positions, a swivel force is generated on the swash plate as a result of the reciprocating pistons and pressure carryover within the piston bores. This swivel torque, depending on certain operating parameters of the pump, urges the swash plate to change its displacement position. In some variable displacement pump control systems, the swivel torque forces are utilized for controlling the displacement. For example, U.S. Pat. No. 5,564,905, which issued on Oct. 15, 1996 to Noah D. Manring, teaches using the forces generated by swivel torques to control the arcuate movement of the port plate within the pump thus controlling the forces being generated by the swivel torques which then are used to control the position of the swash plate. Additionally, U.S. Pat. No. 6,179,570, which issued on Jan. 30, 2001 to David P. Smith, teaches using the inherent forces generated by the swivel torques to aid in the control of the speed of a fluid motor. It is desirable to provide a control that not only uses the inherent swivel forces but to also provide a control that has a minimum number of moving parts, good controllability throughout the whole operating range, is precise and repeatable in positioning the swash plate.

SUMMARY OF THE INVENTION

In one aspect of the subject invention, a variable displacement control arrangement is provided for controlling the displacement of a variable displacement fluid translating device having a pressure outlet port and an adjustable swash plate. The control arrangement includes an actuator mechanism connected to the adjustable swash plate and a source of pressurized pilot fluid connected through a proportional valve arrangement to the actuator mechanism. A force feedback mechanism is disposed between the actuator mechanism and the proportional valve arrangement.

In another aspect of the subject invention, a method of controlling the displacement of a fluid translating device having an adjustable swash plate is provided and includes the steps of providing a source of pressurized pilot fluid, providing an actuator mechanism connected to the adjustable swash plate, providing a proportional valve arrangement between the source of pressurized pilot fluid and the actuator mechanism, and providing a force feedback mechanism between the actuator mechanism and the proportional valve arrangement.

DETAILED DESCRIPTION

Figure 1:
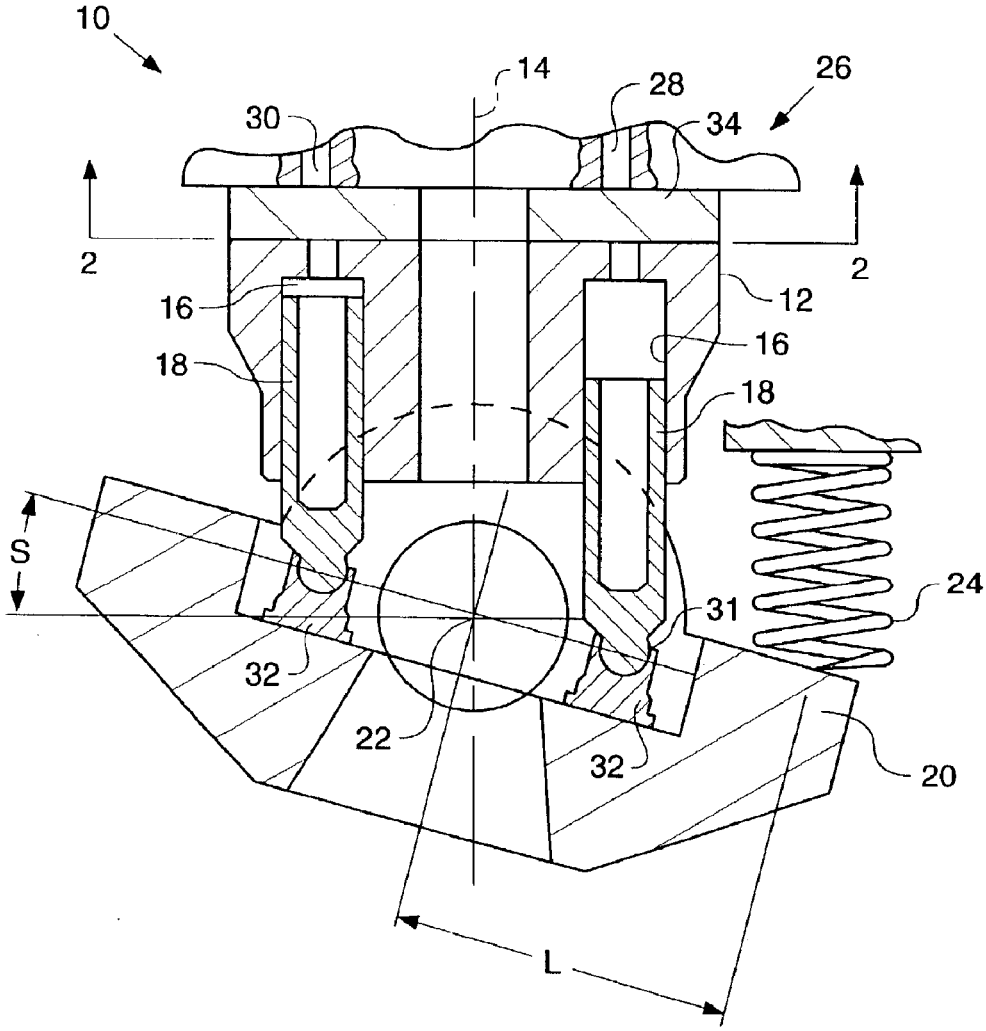
FIG. 1 is a diagrammatic representation of a variable displacement axial piston pump illustrating a barrel having a plurality of bores, a port plate in contact with the barrel, a plurality of piston assemblies disposed in the bores and an adjustable swash plate in contact with the plurality of piston assemblies.
Figure 2:
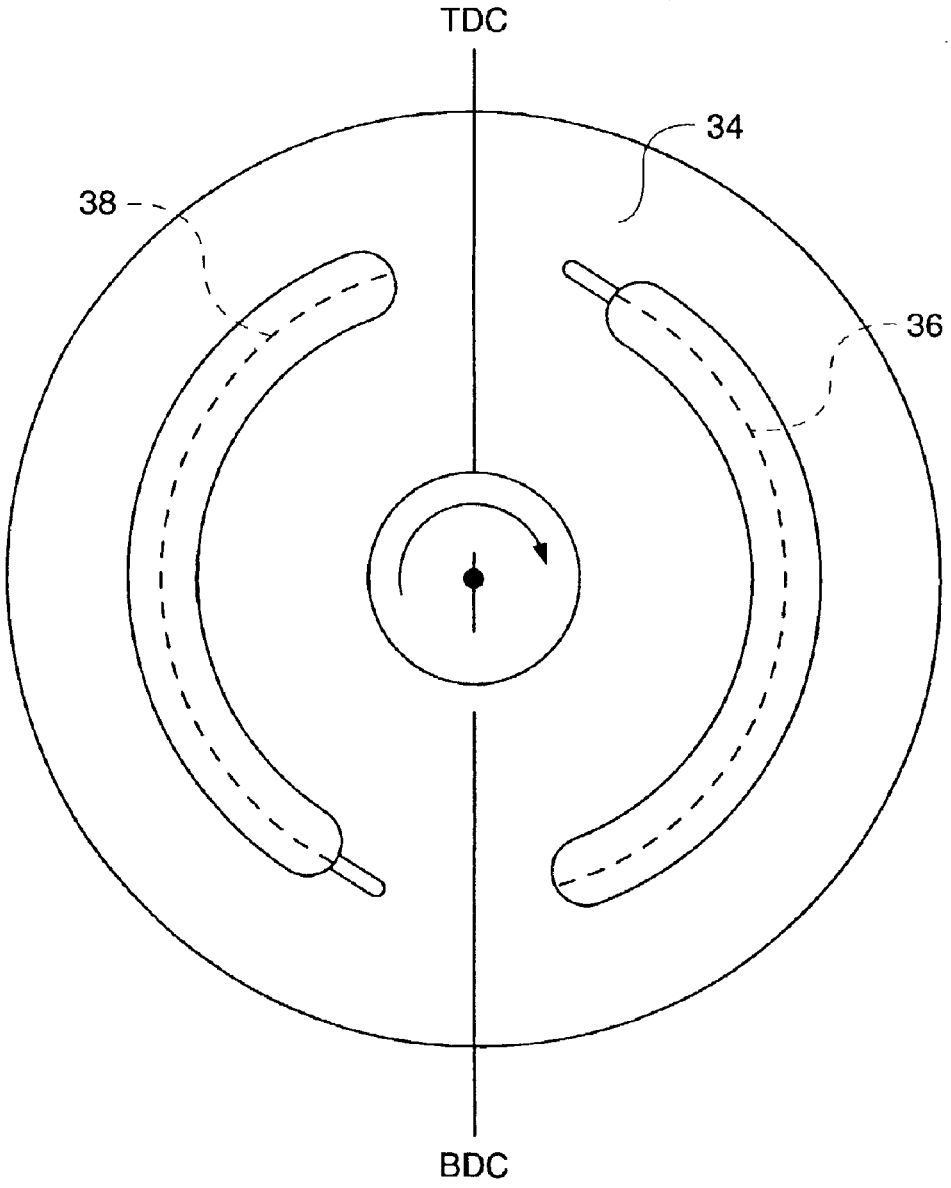
FIG. 2 is a diagrammatic representation of a surface of the port plate of FIG. 1.

Referring to FIGS. 1 and 2, a diagrammatic free-body representation of a fluid translating device 10 is illustrated. The fluid translating device 10 (hereinafter referred to as 'the pump') includes a barrel 12 rotatable about a pump axis 14. The barrel has a plurality of equally-spaced, circumferentially arranged piston bores 16 provided therein. Each one of a plurality of pistons 18 is reciprocatably disposed in the respective piston bores 16. A swash plate 20 is conventionally mounted adjacent one end of the barrel 12 for tilting movement about a swash plate axis 22 to adjust the stroke of the respective pistons. The swash plate 20 is continuously biased towards the maximum displacement position by a spring 24. A stationary head 26 is disposed at the other end of the barrel 12 and has an intake passage 28 and a discharge passage 30. A ball and socket joint 31 connects the base of each piston 18 to a slipper 32 that is maintained in sliding contact with the swash plate 20 in a known manner. The centers of the ball and socket joints 31 are coincident with the swash plate axis 22.

As best illustrated in FIG. 2, a flat timing port plate 34 is disposed between the barrel 12 and the stationary head 26. The port plate 34 has an arcuate intake port 36 and an arcuate discharge port 38 extending therethrough for continuous communication with the respective intake and discharge passages 28,30 in the stationary head 26. In a known manner, the barrel 12 is disposed in sliding contact with the port plate 34 so that the piston bores 16 sequentially open into the intake and discharge ports 36, 38 of the port plate 34 in a timed relationship as the barrel 12 rotates. As is well known, a swivel torque (naturally existing moment) tends to increase or decrease the angle of the swash plate 20 depending on the operating conditions of the fluid translating device 10. With the barrel 12 rotating in the clockwise direction through each rotation, as viewed in FIG. 2, each piston bore 16 sequentially communicates with the intake port 36, sweeps through a BDC position, communicates with the discharge port 38, and after further rotation, sweeps through a TDC position to again communicate with the intake port 36. During this rotation, some of the fluid from the intake port 36 is trapped in the respective piston bores 16 and carried through the BDC position and likewise, some of the pressurized fluid in the discharge port 38 is trapped in the respective piston bores 16 and carried through the TDC position. The accumulated effect of the forces generated by the individual pistons 18 during each revolution results in swivel torques acting on the swash plate 20. As noted above, these swivel torques will either generate a force tending to increase the angle of the swash plate 20 or decrease the angle thereof depending on the operating conditions of the pump 10.

Figure 3:
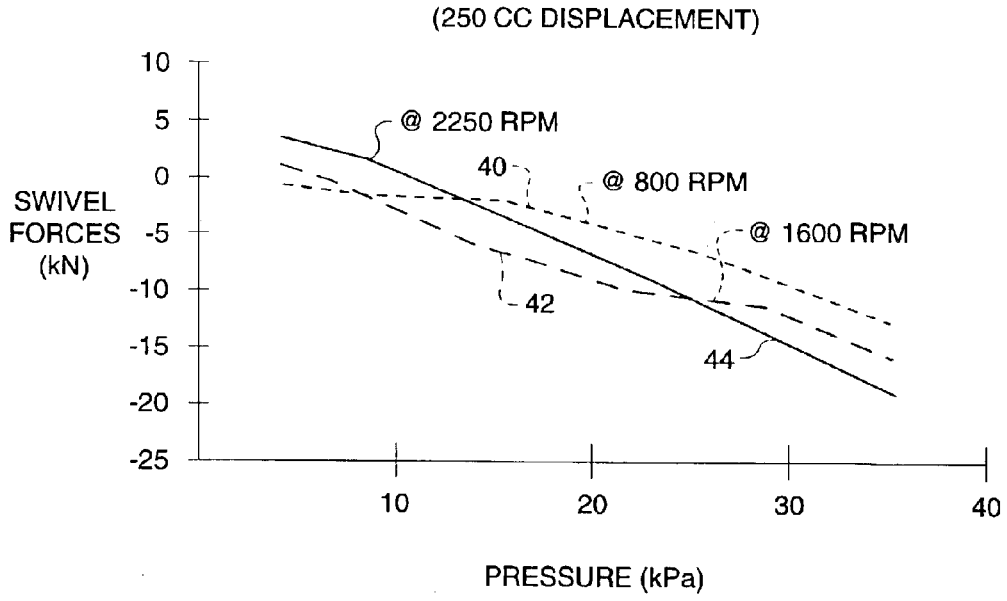
FIG. 3 is a graph illustrating representative swivel forces being generated in one size of a pump.

Referring to FIG. 3, even though swivel torque may be based on many different operating conditions, such as pressure, temperature, port plate architecture and timing to name a few, for example, the shown graph illustrates the relationship of two exemplary operating conditions of the pump 10. A positive swivel torque urges the swash plate 20 towards a greater displacement position and a negative swivel torque urges the swash plate 20 towards a lesser displacement position.

In an exemplary embodiment, the pump 10 may include a maximum displacement of 250 cubic centimeters (cc) having multiple operating speeds (RPM) and which produce system pressures up to 40,000 kilopascals (kPa), for example (FIG. 3). Dotted line 40 represents the swivel forces being generated within the exemplary pump 10 being operated at 800 RPM. Represented by the line 40, the swivel forces are at a minimum value when the system pressure is below 10,000 kPa and, in contrast, are approximately −13 kilonewtons (kN) when the system pressure is approximately 35,000 kPa. Dashed line 42 represents the swivel forces being generated within the exemplary pump 10 while being operated at 1600 RPM. Represented by the line 42, the swivel forces may be approximately +2 kN when the system pressure is below 10,000 kPa and, in contrast, are approximately −17 kN when the system pressure is approximately 35,00 kPa. Solid line 44 represents the swivel forces being generated within the pump 10 while being operated at 2250 RPM. Represented by the line 44, the swivel forces are approximately +5 kN when the system pressure is below 10,000 kPa and, in contrast, are approximately —18 kilonewtons (kN) when the system pressure is approximately 35,000 kPa. It will be understood that pumps of different operating capacities, having different inherent swivel torques may also produce similar results, however, it should be recognized that when operating at higher system pressures, the swivel torques will normally be urging the swash plate 20 towards a smaller displacement position.

Figure 4:
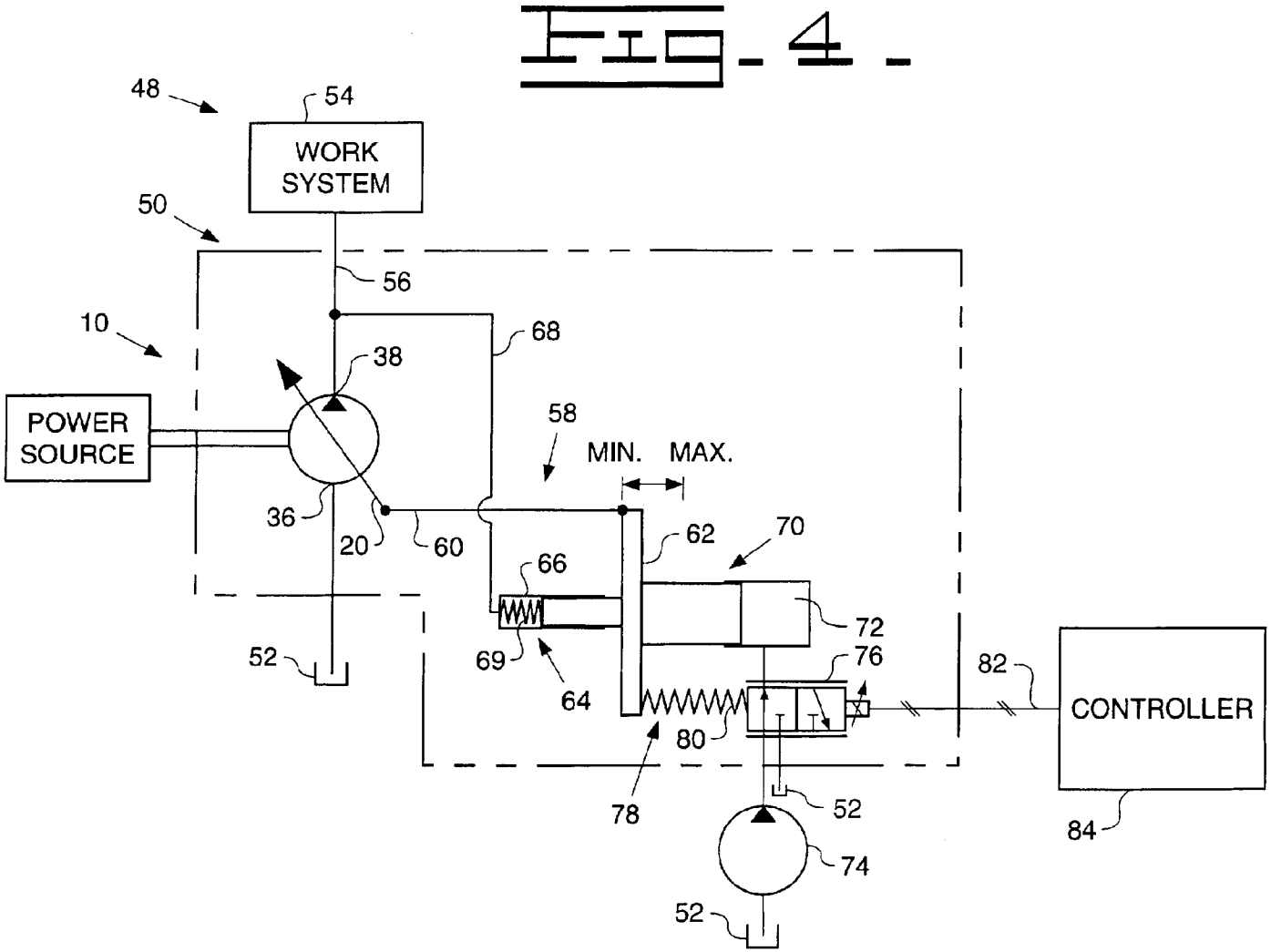
FIG. 4 is a partial diagrammatic and a partial schematic representation of a variable displacement control arrangement incorporating the subject invention.

Referring to FIG. 4, a fluid system 48 is illustrated and includes a variable displacement control arrangement 50 (hereinafter referred to as 'the control arrangement') disposed between a reservoir 52 and a known work system 54. The control arrangement 50 includes the pump 10 having the adjustable swash plate 20 and the intake and discharge passages 36,38. The intake passage 36 is connected to the reservoir 52 and the discharge passage 38 is connected to the work system 54 through an outlet port 56 thereof.

The control arrangement 50 includes an actuator mechanism 58 that is operative to move the swash plate 20 between its minimum (MIN) and maximum (MAX) displacement positions. The actuator mechanism 58 is connected to the swash plate 20 by a mechanical link mechanism 60. The actuator mechanism 58 includes an actuator member 62 disposed within the control arrangement 50 and is connected to the mechanical link mechanism 60. The actuator member 62 has a first end portion 64 of a predetermined cross-sectional area disposed in a first pressure chamber 66 defined in the control arrangement 50. The first pressure chamber 66 is in communication with the outlet port 56 of the pump 10 by a passage 68. A spring member 69 is disposed in the first pressure chamber 66 and is operatively in contact with the first end portion 64 of the actuator member 62. The spring member 69 functions to move the swash plate 20 away from its minimum displacement position during initial startup. The actuator member 62 also has a second end portion 70 of a predetermined cross-sectional area. The second end portion 70 is disposed in a second pressure chamber 72 of the control arrangement 50. In an exemplary embodiment, the cross-sectional area of the first end portion 64 is smaller than the cross-sectional area of the second end portion 70, however it is envisioned that other suitable cross-sectional areas of the first and second end portions 64, 70 may be used. The cross-sectional area of the first end portion 64 of the actuator member 62 is sized to provide a force that would offset the maximum swivel torque that would be acting to decrease the displacement of the pump 10. That force is the cross-sectional area of the first end portion 64 times the pressure at the outlet port 56. The larger, second end portion 70 is sized to produce a force that would offset or balance the maximum swivel torque that would be acting to increase the displacement of the pump 10. That force is the cross-sectional area of the second end portion 70 times a lower control pressure hereinafter described. A source of pressurized pilot fluid 74 (hereinafter referred to as 'the pilot pump') is connected to the second pressure chamber 72 of the actuator mechanism 62 through a proportional valve arrangement 76 (hereinafter referred to as 'the valve') disposed within the control arrangement 50. The pilot pump 74 is one example of the constant, low pressure source noted above. A force feedback mechanism 78, such as a spring 80, is disposed between the actuator member 62 and the valve 76 and is operative to bias the valve 76 towards its first operative position. The valve 76 is movable towards its second operative position in response to an electrical signal received through an electrical line 82 from a controller 84. In the subject arrangement, the controller 84 is of a known electronic type. The degree of movement of the valve 76 is proportional to the magnitude of the electrical signal received from the controller 84. In turn, the magnitude of the electrical signal being generated by the controller may be dependent on a control scheme in the form of a control algorithm, for example.

At the first operative position of the valve 76, pressurized fluid from the pilot pump 74 is in communication with the second pressure chamber 72 and in the second operative position thereof, the pilot pump 74 is blocked from the second pressure chamber 72 and the second pressure chamber 72 is in communication with the reservoir 52.

INDUSTRIAL APPLICABILITY

In use with no electrical signal being generated by the controller 84, the actuator member 62 is in its leftmost position, as viewed in FIG. 4, since the pressure of the fluid from the pilot pump 74 acting on the cross-sectional area of the second end portion 70 is sufficient to move the actuator member 62 and thus move the swash plate 20 to its minimum displacement position.

When pressurized fluid flow is required in the work system 54, the controller 84 generates an electrical signal and directs the electrical signal through the electrical line 82 to the solenoid of the valve 76. The valve 76 moves against the bias of the force feedback mechanism 78 an amount proportional to the magnitude of the electrical signal. As the valve 76 moves towards its second operative position, a portion of the pressurized fluid within the second pressure chamber 72 is vented to the reservoir 52 thus reducing the pressure within the second pressure chamber 72. As a result of the lower pressure within the second pressure chamber 72, the actuator member 62 moves in a rightward direction, as viewed in FIG. 4. As the actuator member 62 moves, the displacement of the swash plate 20 is increased through the action of the mechanical link mechanism 60. As the actuator member 62 moves in the rightward direction, the force of the force feedback mechanism 78 is increased. Once the force of the force feedback mechanism 78 is increased to the point at which it overcomes the force established by the electrical signal, the valve 76 is maintained in a balanced position, thus maintaining a constant pressure in the second pressure chamber 72. If additional pressurized fluid is needed in the work system 54, the controller 84 increases the electrical signal and the force created by the solenoid moves the valve 76 further to the left, thus further decreasing the pressure in the second pressure chamber 72. With a further decrease of pressure in the second pressure chamber 72, the actuator member 62 moves further to the right resulting in the swash plate 20 moving to a greater angle of displacement. Again, as the force of the force feedback mechanism 78 increases, it reaches a point again at which the force therefrom balances the force established by the electrical signal and the pressure in the second pressure chamber 72 is maintained at a constant pressure level. As can be readily recognized from the above, any increase or decrease in the electrical signal from the controller 84 results in a proportional increase or decrease of the displacement of the pump 10.

In view of the foregoing, it is readily apparent that a variable displacement control arrangement 50 is provided that uses the favorable direction of the inherent swivel torques within the pump 10 to provide a simple control arrangement that has good controllability throughout the whole operating range, independent of the pump discharge pressure, and is very repeatable and precise in positioning the swash plate 20. This repeatability comes from the inherent, internal closed loop of the force feedback/valve mechanism. This same control arrangement 50 could be used for other modes of operation, such as, flow control pressure cut-off, torque limiting control, etc. by merely using a different control software within the controller 84.

Other aspects, objects and advantages of this invention can be obtained from a study of the drawings, the disclosure and the appended claims.

What is claimed is:

1. A variable displacement control arrangement, comprising:

a variable displacement fluid translating device having a pressure outlet port and a displacement adjusting member;

an actuator mechanism connected to the displacement adjusting member and configured to move the displacement adjusting member;

a source of pressurized fluid;

a proportional valve arrangement in communication with the actuator mechanism and the source of pressurized fluid;

the proportional valve arrangement configured to selectively direct the pressurized fluid to the actuator mechanism, thereby causing movement of the displacement adjusting member;

the pressurized fluid supplied to the proportional valve arrangement always having a substantially constant pressure.

2. The variable displacement control arrangement of claim 1 wherein the actuator mechanism has a first end portion of a predetermined cross sectional area disposed in a first pressure chamber connected to the outlet port of the variable displacement fluid translating device and a second end portion of a predetermined cross sectional area disposed in a second pressure chamber connected to the proportional valve arrangement.

3. The variable displacement control arrangement of claim 2 wherein the proportional valve arrangement is electrically controlled.

4. The variable displacement control arrangement of claim 2 wherein the cross sectional area of the first end portion of the actuator mechanism is smaller than the cross sectional area of the second end portion thereof.

5. The variable displacement control arrangement of claim 4, further comprising a force feedback mechanism disposed between the actuator mechanism and the proportional valve arrangement;

wherein the proportional valve arrangement is movable between first and second operative positions and is biased to the first operative position by the force feedback mechanism.

6. The variable displacement control arrangement of claim 5 wherein at the first operative position of the proportional valve arrangement, the source of pressurized fluid is in open communication with the second end portion of the actuator mechanism.

7. The variable displacement control arrangement of claim 5 wherein at the second operative position of the proportional valve arrangement, the second pressure chamber of the actuator mechanism is connectable to a reservoir.

8. The variable displacement control arrangement of claim 7 wherein the proportional valve arrangement is movable towards the second operative position in response to receipt of an electrical signal.

9. The variable displacement control arrangement of claim 8 including a spring member disposed in the first pressure chamber of the actuator mechanism and the actuator mechanism includes an actuator member, the spring member being operative to bias the actuator member towards the second pressure chamber.

10. The variable displacement control arrangement of claim 8 in combination with a fluid system having a work system connected to the outlet of the fluid translating device and an electronic controller connected to the proportional valve arrangement.

11. A method of controlling the displacement of a fluid translating device having a displacement adjusting member, comprising:

providing a source of pressurized fluid;

providing an actuator mechanism connected to the displacement adjusting member;

providing a proportional valve arrangement between the source of pressurized fluid and the actuator mechanism, the proportional valve arrangement configured to selectively direct the pressurized fluid to the actuator mechanism;

the pressurized fluid supplied to the proportional valve arranaement always having a substantially constant pressure.

12. The method of claim 11 including the step of connecting a first pressure chamber to the outlet port of the fluid translating device and providing a first end portion thereon that is exposed to the first pressure chamber thereof.

13. The method of claim 12 including the step of connecting a second pressure chamber to the proportional valve arrangement and providing a second end portion thereon that is exposed to the second pressure chamber thereof.

14. The method of claim 13 including the step of making the cross sectional area of the first end portion of the actuator mechanism smaller than that of the cross sectional area of the second end portion thereof.

15. A method of controlling the displacement of a fluid translating device having a displacement adjusting member, comprising:

providing a source of pressurized fluid;

providing an actuator mechanism connected to the displacement adjusting member, the actuator mechanism having a first end portion and a second end portion;

providing a proportional valve arrangement between the source of pressurized fluid and the actuator mechanism; and sizing the cross sectional area of at least one of the first and second end portions of the actuator mechanism to counteract a maximum swivel force acting to change the displacement of the fluid translating device.

16. The method of claim 15, further including the step of sizing the cross sectional area of the first end portion of the actuator mechanism to counteract the maximum swivel force acting to decrease the displacement of the fluid translating device; and sizing the second end portion of the actuator mechanism to counteract the maximum swivel force acting to increase the displacement of the fluid translating device.

* * * * *